US009809023B2

(12) United States Patent
Koide et al.

(10) Patent No.: US 9,809,023 B2
(45) Date of Patent: Nov. 7, 2017

(54) LIQUID EJECTING DEVICE

(71) Applicant: Brother Kogyo Kabushiki Kaisha, Nagoya-shi, Aichi-ken (JP)

(72) Inventors: Shohei Koide, Nagoya (JP); Keita Hirai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/086,480

(22) Filed: Mar. 31, 2016

(65) Prior Publication Data

US 2017/0087842 A1 Mar. 30, 2017

(30) Foreign Application Priority Data

Sep. 28, 2015 (JP) ..... 2015-189283

(51) Int. Cl.
*B41J 2/14* (2006.01)

(52) U.S. Cl.
CPC ..... *B41J 2/14209* (2013.01); *B41J 2/14233* (2013.01); *B41J 2002/14241* (2013.01); *B41J 2002/14491* (2013.01); *B41J 2202/18* (2013.01)

(58) Field of Classification Search
None
See application file for complete search history.

(56) References Cited

U.S. PATENT DOCUMENTS

| | | | |
|---|---|---|---|
| 7,578,581 | B2 | 8/2009 | Watanabe |
| 7,996,991 | B2 | 8/2011 | Oguri |
| 9,238,367 | B2 * | 1/2016 | Kato ..... B41J 2/14233 |
| 2006/0125878 | A1 | 6/2006 | Watanabe |
| 2008/0127471 | A1 | 6/2008 | Matsuzawa |
| 2008/0151008 | A1 | 6/2008 | Fukugawa et al. |
| 2009/0229126 | A1 | 9/2009 | Oguri |
| 2014/0267499 | A1 | 9/2014 | Kato |
| 2014/0267505 | A1 | 9/2014 | Nakao |

FOREIGN PATENT DOCUMENTS

| | | | |
|---|---|---|---|
| EP | 1671796 | A1 | 6/2006 |
| JP | 2003-159801 | A | 6/2003 |
| JP | 2009-255536 | A | 11/2009 |

OTHER PUBLICATIONS

Jan. 31, 2017—(EP) Extended European Search Report—App 16162966.2.

* cited by examiner

*Primary Examiner* — Lisa M Solomon
(74) *Attorney, Agent, or Firm* — Banner & Witcoff, Ltd.

(57) ABSTRACT

A liquid ejecting device, including: a flow-path defining member having a pressure chamber formed therein; a piezoelectric actuator constituted by a plurality of layers which includes a piezoelectric layer, a common electrode, and an individual electrode, superposed on the flow-path defining member, and having a through-hole communicating with the pressure chamber; an annular conductor disposed on one of opposite surfaces of the piezoelectric actuator remote from the flow-path defining member such that a part of the layers are sandwiched between the annular conductor and the common electrode, the annular conductor surrounding a periphery of the through-hole; and a liquid supply member having a supply path communicating with the through-hole and bonded to the one of the opposite surfaces via the annular conductor, wherein the annular conductor is connected to a terminal configured to be given a predetermined constant potential and is exposed to a flow path defined by the through-hole.

12 Claims, 11 Drawing Sheets

LIQUID EJECTING DEVICE

CROSS REFERENCE TO RELATED APPLICATION

The present application claims priority from Japanese Patent Application No. 2015-189283, which was filed on Sep. 28, 2015, the disclosure of which is herein incorporated by reference in its entirety.

BACKGROUND

Technical Field

The disclosure relates to a liquid ejecting device.

Description of Related Art

An ink-jet head configured to eject ink from nozzles is known as one example of a liquid ejecting device. The known ink-jet head includes a flow-path defining plate in which a plurality of pressure chambers are formed, a piezoelectric actuator provided on the flow-path defining plate so as to cover the pressure chambers, and a reservoir defining plate bonded to an upper surface of the piezoelectric actuator.

The flow-path defining plate is provided with a manifold (communication portion) extending in a direction in which the pressure chambers are arranged. The manifold is open to an upper surface of the flow-path defining plate. The piezoelectric actuator has a staked structure including an oscillating plate, a lower electrode layer stacked on the oscillating plate, a piezoelectric layer, and an upper electrode layer. One piezoelectric element is constituted by the lower electrode layer, the piezoelectric layer, and the upper electrode layer for giving a pressure to ink in a corresponding one of the pressure chambers. The lower electrode layer is a common electrode, and the upper electrode layer is an individual electrode.

The piezoelectric actuator is provided with a through-hole corresponding to an opening of the manifold. A metallic layer is formed around the periphery of the through-hole so as to surround the through-hole. The metallic layer is formed independently of the electrodes of each piezoelectric element and is not conducted to the electrodes. A reservoir defining plate is bonded to the piezoelectric actuator at a region thereof around the periphery of the through-hole via the surrounding metallic layer. A flow path formed in the reservoir defining plate communicates with the manifold of the flow-path defining plate via the through-hole of the piezoelectric actuator.

SUMMARY

In the liquid ejecting device described above, in an instance where the liquid supplied from the reservoir defining plate is electrically charged, there is generated a potential difference between the liquid and the common electrode of the piezoelectric element. The potential difference may cause a short circuit in minute defects existing in the crystal grain boundary of the piezoelectric layer, causing a risk of damaging the actuator. Further, when the potential of the liquid becomes unstable by being electrically charged, liquid droplets ejected from the nozzles are prevented from traveling in an intended direction. To avoid these drawbacks, it is important to keep the potential of the liquid at a constant level, preferably, at the same potential as the common electrode. However, if the head is provided with any structure exclusively for maintaining the potential of the liquid at a constant level, the size of the head is inevitably increased.

An aspect of the disclosure relates to a liquid ejecting device in which a potential of a liquid is maintained at a constant level without increasing the size of the device.

In one aspect of the disclosure, a liquid ejecting device includes: a flow-path defining member in which a pressure chamber is formed; a piezoelectric actuator constituted by a plurality of layers stacked on one another and including a piezoelectric layer, a common electrode disposed on one surface side of the piezoelectric layer, and an individual electrode disposed on another surface side of the piezoelectric layer, the piezoelectric actuator being superposed on the flow-path defining member and having a through-hole communicating with the pressure chamber; an annular conductor disposed on one of opposite surfaces of the piezoelectric actuator remote from the flow-path defining member such that a part of the plurality of layers are sandwiched between the annular conductor and the common electrode, the annular conductor surrounding a periphery of the through-hole; and a liquid supply member in which a supply path communicating with the through-hole is formed, the liquid supply member being bonded to the one of the opposite surfaces of the piezoelectric actuator via the annular conductor, wherein the annular conductor is connected to a terminal configured to be given a predetermined constant potential and is exposed to a flow path defined by the through-hole.

In another aspect of the disclosure, a liquid ejecting device includes: a flow-path defining member in which a pressure chamber is formed; a piezoelectric actuator constituted by a plurality of layers stacked on one another and including a piezoelectric layer, a common electrode disposed on one surface side of the piezoelectric layer, and an individual electrode disposed on another surface side of the piezoelectric layer, the piezoelectric actuator being superposed on the flow-path defining member and having a through-hole communicating with the pressure chamber; an annular conductor disposed on one of opposite surfaces of the piezoelectric actuator remote from the flow-path defining member such that a part of the plurality of layers are sandwiched between the annular conductor and the common electrode, the annular conductor surrounding a periphery of the through-hole; a contact hole formed through the part of the plurality of layers of the piezoelectric actuator so as to electrically connect the annular conductor and the common electrode; and a liquid supply member in which a supply path communicating with the through-hole is formed, the liquid supply member being bonded to the one of the opposite surfaces of the piezoelectric actuator vie the annular conductor.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF EMBODIMENTS

Figure 1:
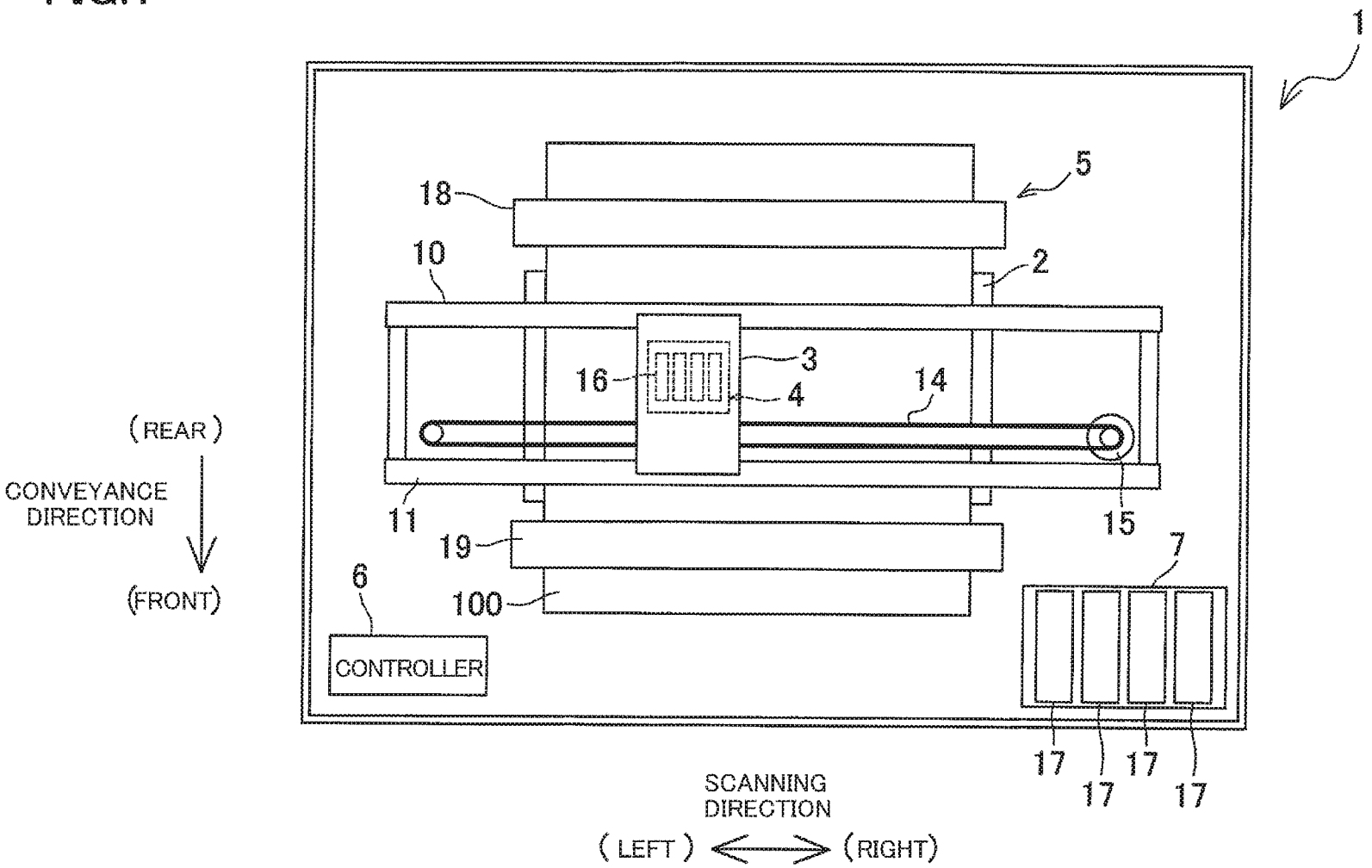
FIG. 1 is a plan view schematically showing an ink-jet printer according to a first embodiment.

Referring first to FIG. 1, there will be explained a schematic structure of an ink-jet printer 1 according to a first embodiment. Directions respectively indicated as "front", "rear", "right", and "left" in FIG. 1 are respectively defined as a front side, a rear side, a right side, and a left side of the printer 1. Further, one of opposite sides of the sheet of FIG. 1 corresponding to the front surface of the sheet is defined as an upper side of the printer 1 while the other side corresponding to the back surface of the sheet is defined as a lower side of the printer 1. The following explanation is based on these definitions.

Overall Structure of Printer

As shown in FIG. 1, the ink-jet printer 1 includes a platen 2, a carriage 3, an ink-jet head 4, a conveyor mechanism 5, and a controller 6.

A recording sheet 100, as one example of a recording medium, is placed on the platen 2. The carriage 3 is movable in a region in which the carriage 3 is opposed to the platen 2, so as to reciprocate in a right-left direction (hereinafter referred also to as "scanning direction" where appropriate) along two guide rails 10, 11. An endless belt 14 is connected to the carriage 3. When the endless belt 14 is driven by a carriage drive motor 15, the carriage 3 reciprocates in the scanning direction.

The ink-jet head 4 is mounted on the carriage 3 and is configured to move in the scanning direction with the carriage 3. The ink-jet head 4 includes four head units 16 arranged in the scanning direction. The four head units 16 are connected, through respective tubes (not shown), to a cartridge holder 7 that holds four ink cartridges 17 in which black ink, yellow ink, cyan ink, and magenta ink are respectively stored. Each head unit 16 has a plurality of nozzles 24 (FIGS. 2-4) formed in its lower surface (corresponding to the back surface of the sheet of FIG. 1). The nozzles 24 of each head unit 16 eject ink supplied from a corresponding one of the ink cartridges 17 to the recording sheet 100 placed on the platen 2.

The conveyor mechanism 5 includes two conveyor rollers 18,19 disposed so as to sandwich the platen 2 therebetween in a front-rear direction. The conveyor mechanism 5 is configured such that the two conveyor rollers 18, 19 convey the recording sheet 100 placed on the platen 2 toward the front side, namely, in a conveyance direction.

The controller 6 includes a read only memory (ROM), a random access memory (RAM), and an application specific integrated circuit (ASIC) including various control circuits. The controller 6 executes various processes such as a printing process on the recording sheet 100 by the ASIC according to programs stored in the ROM. For instance, the controller 6 controls the ink-jet head 4, the carriage drive motor 15, and other related components in the printing process based on a print command input from an external device such as a personal computer (PC), such that an image or the like is printed on the recording sheet 100. Specifically, the controller 6 controls the printer 1 so as to alternately perform an ink ejecting operation in which the ink-jet head 4 ejects the ink while moving in the scanning direction with the carriage 3 and a conveying operation in which the recording sheet 100 is conveyed by the conveyor rollers 18, 19 in the conveyance direction by a predetermined amount.

Detailed Structure of Ink-Jet Head

There will be explained a structure of each head unit 16 of the ink-jet head 4. Because the four head units 16 are identical with each other in structure, one of the four head units 16 will be explained below.

Figure 2:
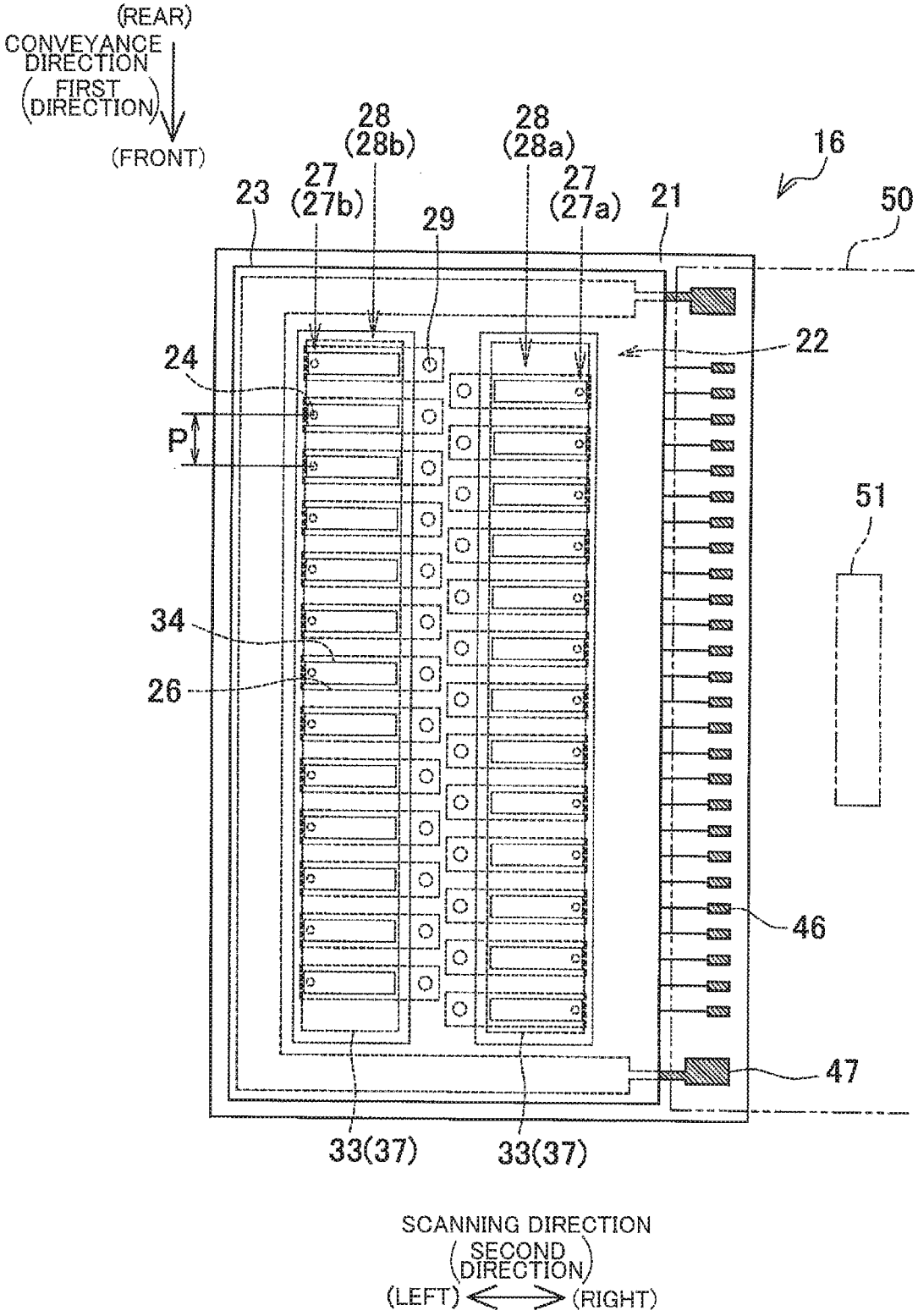
FIG. 2 is a plan view of a head unit.
Figure 3:
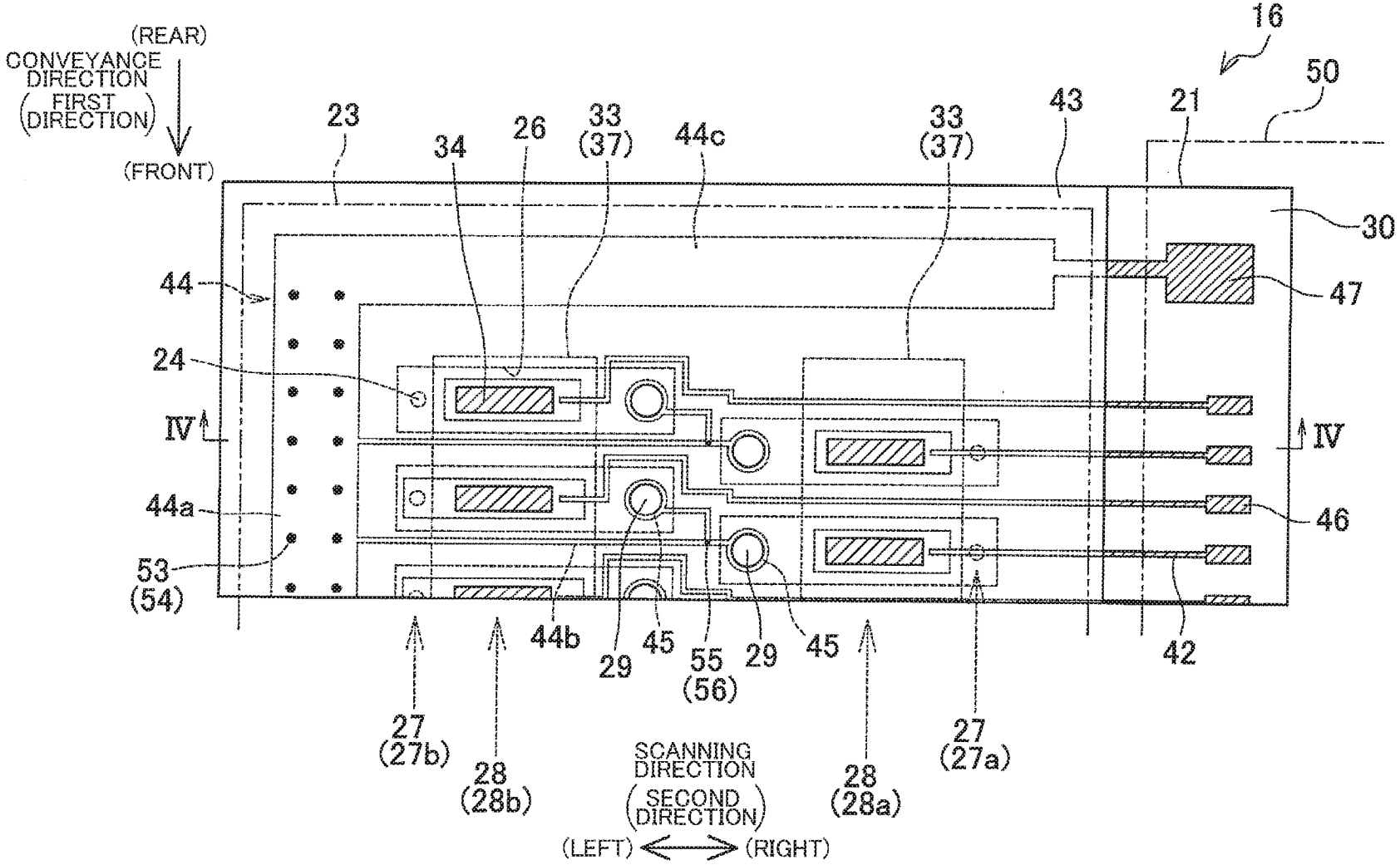
FIG. 3 is a partially enlarged plan view of FIG. 2.
Figure 4:
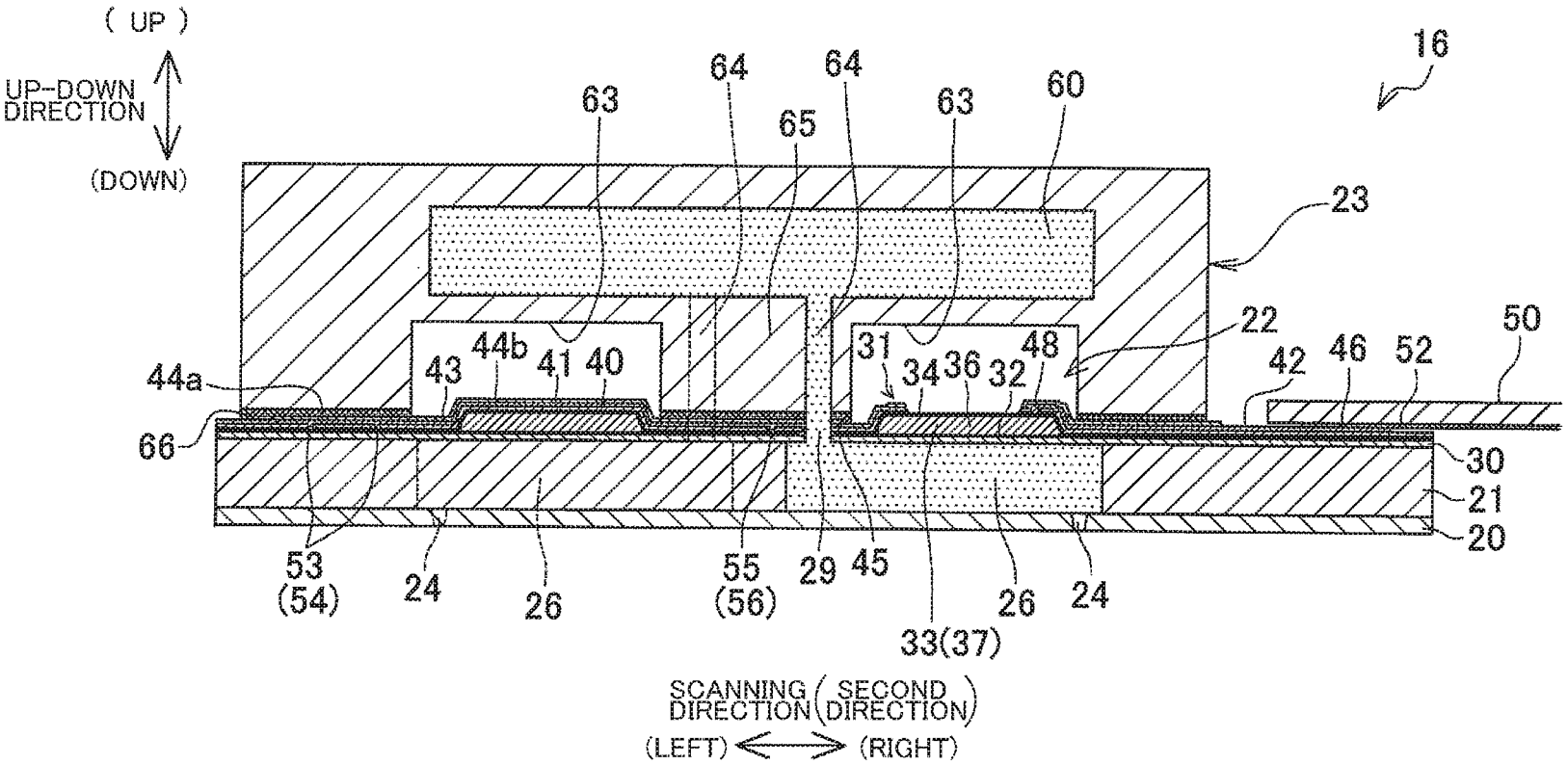
FIG. 4 is a cross-sectional view taken along the line IV-IV in FIG. 3.
Figure 5:
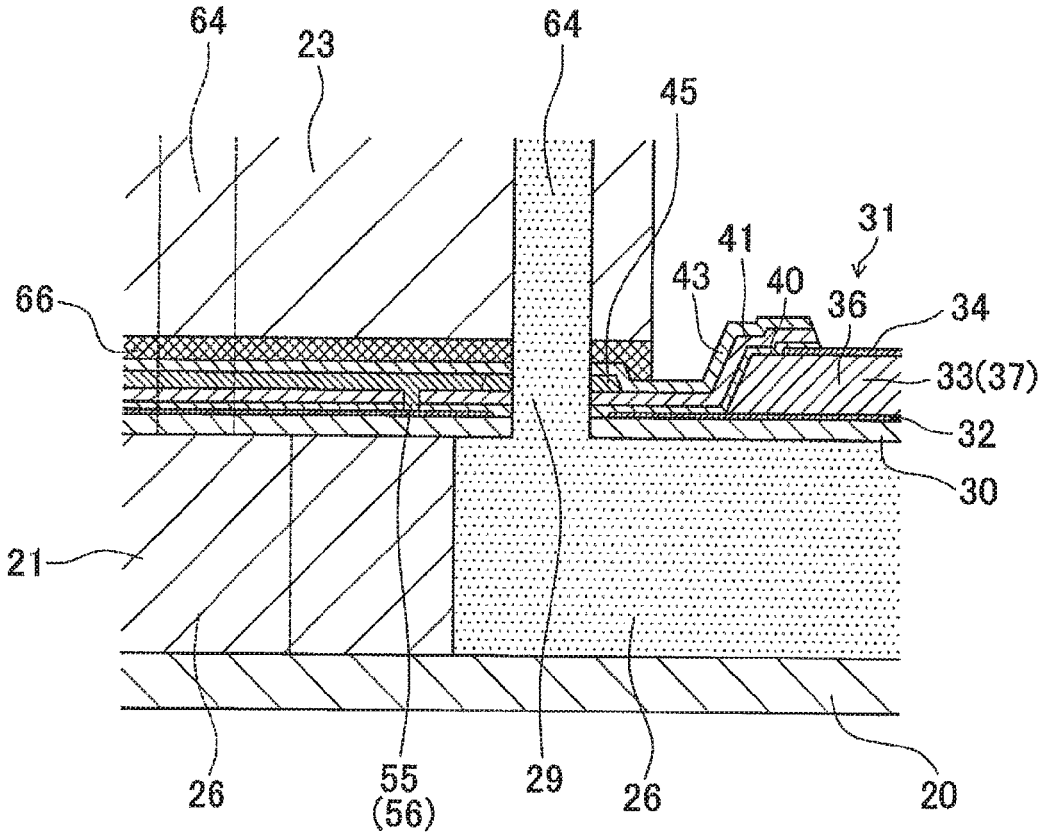
FIG. 5 is a partially enlarged cross-sectional view of FIG. 4.

FIG. 2 is a plan view of the head unit 16. FIG. 3 is a partially enlarged plan view of FIG. 2. FIG. 4 is a cross-sectional view taken along the line Iv-Iv in FIG. 3. FIG. 5 is a partially enlarged cross-sectional view of FIG. 4. As shown in FIGS. 2-5, the head unit 16 includes a nozzle plate 20, a flow-path defining plate 21, a piezoelectric actuator 22 including a plurality of piezoelectric elements 31, and a reservoir defining member 23. For simplicity's sake, a COF 50 joined to an end of the flow-path defining plate 21 is schematically illustrated by the long dashed double-short dashed line in FIGS. 2 and 3, and the reservoir defining member 23 is schematically illustrated by the long dashed double-short dashed line in FIG. 3.

Nozzle Plate

The nozzle plate 20 is formed of silicon or the like. The plurality of nozzles 24 are formed in the nozzle plate 20. As shown in FIG. 2, the nozzles 24 are arranged in the conveyance direction and form two nozzle rows 27 (27*a*, 27*b*) arranged in the scanning direction. In an instance where a pitch at which the nozzles 24 in one nozzle row 27 is represented as P, the nozzles 24 in the nozzle row 27*a* are shifted in the conveyance direction by a distance P/2 with respect to the nozzles 24 in the nozzle row 27*b*.

Flow-Path Defining Plate

The flow-path defining plate 21 is a plate formed of a silicon single crystal. In the flow-path defining plate 21, a plurality of pressure chamber 26 respectively communicating with the plurality of nozzles 24 are formed. Each pressure chamber 26 has a rectangular planar shape extending in the scanning direction. The plurality of pressure chambers 26 form two pressure-chamber rows 28 (28*a*, 28*b*) arranged in the scanning direction, so as to correspond to the two nozzle rows 27. The lower surface of the flow-path defining plate 21 is covered with the nozzle plate 20. As viewed from the up-down direction, an outer end portion of each pressure chamber 26 in the scanning direction overlaps a corresponding one of the nozzles 24. As shown in FIG. 2, a right end portion of each pressure chamber 26 in the right pressure-chamber row 28*a* overlaps a corresponding one of the nozzles 24, and a left end portion of each pressure chamber 26 in the left pressure-chamber row 28*b* overlaps a corresponding one of the nozzles 24.

Piezoelectric Actuator

The piezoelectric actuator 22 has a stacked structure constituted by a plurality of layers including an insulating layer 30 and a piezoelectric layer 37 superposed on the flow-path defining plate 21. The piezoelectric actuator 22 is provided on an upper surface of the flow-path defining plate 21 so as to cover the plurality of pressure chambers 26. The piezoelectric actuator 22 is provided with through-holes 29 at portions thereof corresponding to inner end portions of the respective pressure chambers 26. Each through-hole 29 is formed through the plurality of layers so as to communicate with a corresponding one of the pressure chambers 26. Specifically, in the right pressure-chamber row 28*a*, the through-hole 29 overlaps the left end portion of a corresponding one of the pressure chambers 26. In the left pressure-chamber row 28*b*, the through-hole 29 overlaps the right end portion of a corresponding one of the pressure chambers 26. Ink is supplied from a reservoir 60 of the reservoir defining member 23 to pressure chambers 26 via the respective through-holes 29.

The insulating layer 30 is a silicon dioxide layer formed by oxidizing the surface of the silicon plate, for instance. The insulating layer 30 has a thickness of 1.0-1.5 μm, for instance. A plurality of piezoelectric elements 31 are provided at positions of an upper surface of the insulating layer 30 overlapping the plurality of pressure chambers 26. Each piezoelectric element 31 gives, to the ink in the corresponding pressure chamber 26, an ejection energy for ejecting the ink from the corresponding nozzle 24.

The piezoelectric element 31 will be explained. On the insulating layer 30, a common electrode 32, two piezoelectric members 33, and a plurality of individual electrodes 34 are stacked in this order.

The common electrode 32 is provided on the upper surface of the insulating layer 30. As shown in FIGS. 4 and 5, the common electrode 32 is formed over substantially the entire upper surface of the insulating layer 30. The common electrode 32 is formed of platinum (Pt), for instance. The common electrode 32 has a thickness of 0.1 μm, for instance.

The two piezoelectric members 33 are provided on the common electrode 32 so as to correspond to the respective two pressure-chamber rows 28. Each piezoelectric member 33 is obtained by patterning the piezoelectric layer 37 prepared by film forming of a piezoelectric material such as lead zirconate titanate (PZT). The piezoelectric layer 37 may be formed of a material other than the PZT, such as a non-lead piezoelectric material that does not contain the lead. Each piezoelectric member 33 has a thickness of 1.0-2.0 μm, for instance. Each piezoelectric member 33 has a long planar shape extending in the conveyance direction and is disposed across the pressure chambers 26 of a corresponding one of the two pressure-chamber rows 28 in the conveyance direction.

A plurality of individual electrodes 34 are formed at positions of an upper surface of each piezoelectric member 33 respectively corresponding to the pressure chambers 26. Each individual electrode 34 has a rectangular planar shape smaller than the pressure chamber 26 and is disposed to as to overlap a central portion of the corresponding pressure chamber 26. For instance, each individual electrode 34 is formed of iridium (Ir) or platinum (Pt) and has a thickness of 0.1 μm.

In the configuration described above, one piezoelectric element 31 is formed, for one pressure chamber 26, by one individual electrode 34, a portion of the common electrode 32 facing the one pressure chamber 26, and a portion of the piezoelectric member 33 sandwiched by the one individual electrode 34 and the portion of the common electrode 32. The portion of the piezoelectric member 33 sandwiched by the common electrode 32 located on the lower surface side of the piezoelectric member 33 and the one individual electrode 34 located on the upper surface side of the piezoelectric member 33 will be hereinafter referred to as an active portion 36. When there is generated a potential difference between the individual electrode 34 and the common electrode 32 in each piezoelectric element 31 and an electric field accordingly acts on the active portion 36 in its thickness direction, the active portion 36 deforms in the plane direction. Due to the deformation of the active portion 36, the piezoelectric element 31 is subjected to flexural deformation as a whole, so that a portion of the piezoelectric element 31 facing the pressure chamber 26 is deformed in the up-down direction orthogonal to the plane direction of the insulating layer 30.

As shown in FIGS. 4 and 5, the piezoelectric actuator 22 further includes a piezoelectric-member protective layer 40 and an intermediate insulating layer 41, in addition to the insulating layer 30 and the piezoelectric elements 31.

As shown in FIGS. 4 and 5, the piezoelectric-member protective layer 40 is disposed so as to cover the two piezoelectric members 33. The piezoelectric-member protective layer 40 is a layer for protecting the piezoelectric members 33 (the piezoelectric layers 37) such as for preventing entry of the aqueous component in the air into the piezoelectric members 33. For instance, the piezoelectric-member protective layer 40 is formed of a material having low water permeability, e.g., an oxide such as aluminum oxide (alumina: $Al_2O_3$), silicon oxide (SiOx), or tantalum oxide (TaOx) or a nitride such as silicon nitride (SiN).

An intermediate insulating layer 41 is formed on the piezoelectric-member protective layer 40. While the material for the intermediate insulating layer 41 is not limited, the intermediate insulating layer 41 is formed of silicon dioxide ($SiO_2$), for instance. The intermediate insulating layer 41 has a thickness of 0.3-0.5 μm, for instance. The intermediate insulating layer 41 is provided for enhancing insulation between the common electrode 32 and individual wirings 42 (which will be explained) connected to the respective individual electrodes 34.

As shown in FIGS. 3-5, the piezoelectric-member protective layer 40 and the intermediate insulating layer 41 are partly removed at a central portion of each individual electrode 34 formed on the piezoelectric members 33. Further, a wiring protective layer 43, which covers the individual wirings 42 and a common wiring 44, is also removed at the central portion of each individual electrode 34. That is, the central portion of each individual electrode 34 is not covered by the piezoelectric-member protective layer 40, the intermediate insulating layer 41, and the wiring protective layer 43. Thus, the piezoelectric members 33 are not hindered from being deformed due to provision of the layers 40, 41, 43 thereon.

Individual Wirings and Common Wiring

On the upper surface of the piezoelectric actuator 22, namely, on the upper surface of the intermediate insulating layer 41, a plurality of individual wirings 42 and the common wiring 44 are provided. The individual wirings 42 and the common wiring 44 are formed of a material having low electric resistivity such as aluminum (Al) or gold (Au). The individual wirings 42 and the common wiring 44 have a thickness of 1.0 μm, for instance.

One end of each individual wiring 42 overlaps one end of the upper surface of the corresponding piezoelectric member 33. The one end of each individual wiring 42 is conducted to the corresponding individual electrode 34 via a connecting member 48 in a contact hole that is formed through the piezoelectric-member protective layer 40 and the intermediate insulating layer 41. Each individual wiring 42 is drawn rightward from the corresponding individual electrode 34 and extends to a right end portion of the flow-path defining plate 21 at which the flow-path defining plate 21 is not covered by the reservoir defining member 23. A plurality of drive terminals 46 having a larger width than the individual wirings 42 are provided on the right end portion of the upper surface of the flow-path defining plate 21 so as to be arranged in the conveyance direction. The plurality of individual wirings 42 are respectively connected to the plurality of drive terminals 46. The COF 50 which will be explained is connected to the drive terminals 46.

The common wiring 44 includes a first conductive portion 44*a*, a plurality of second conductive portions 44*b*, two third conductive portions 44*c*.

The first conductive portion 44*a* is disposed on the left side of the plurality of pressure chambers 26, namely, on one side of the pressure chambers 26 that is opposite to another side on which the individual wirings 42 are drawn. In other words, the first conductive portion 44*a* is disposed on one of opposite sides of the pressure chambers 26 in the scanning direction nearer to a left end portion of the head unit 16. The first conductive portion 44*a* extends in the conveyance direction that coincides with the direction of arrangement of the plurality of pressure chambers 26. A plurality of contact holes 53 are formed through the intermediate insulating layer 41 and the piezoelectric-member protective layer 40 which are disposed between the first conductive portion 44*a* and the common electrode 32. The first conductive portion 44*a* is connected to the common electrode 32 via connecting members 54 which are formed of a conductive material and which are provided in the respective contact holes 53.

Each second conductive portion 44*b* extends rightward from the first conductive portion 44*a*, passes between corresponding adjacent two pressure chambers 26 in the left pressure-chamber row 28*b*, and reaches an intermediate region between the two pressure-chamber rows 28*a*, 28*b*. In the intermediate region between the two pressure-chamber rows 28*a*, 28*b*, a plurality of contact holes 55 are formed through the piezoelectric-member protective layer 40 and the intermediate insulating layer 41 so as to respectively correspond to the plurality of second conductive portions 44*b*. Each second conductive portion 44*b* is connected to the common electrode 32 via a corresponding one of connecting members 56 which are formed of a conductive material and which are provided in the respective contact holes 55.

As shown in FIGS. 2 and 3, the two third conductive portions 44*c* extend respectively from a front end portion and a rear end portion of the first conductive portion 44*a* to the right end portion of the flow-path defining plate 21 at which the flow-path defining plate 21 is not covered by the reservoir defining member 23. On the upper surface of the right end portion of the flow-path defining plate 21, two ground terminals 47 are provided. The two ground terminals 47 are respectively disposed on a front side and a rear side of a group of the drive terminals 46. The two third conductive portions 44*c* are connected to the respective two ground terminals 47. The two ground terminals 47 are connected to the COF 50, thereby functioning as terminals to which a ground potential is given.

In this configuration, the common electrode 32 is connected to the ground terminals 47 via the first conductive portion 44*a*, the second conductive portions 44*b*, and the third conductive portions 44*c* of the common wiring 44. Thus, the potential of the common electrode 32 is held at the ground potential. It may be considered that the common electrode 32 and the ground terminals 47 are conducted by two routes, namely, a route extending from the first conductive portion 44*a* and passing through the connecting members 54 and a route extending from the first conductive portion 44*a* and passing through the second conductive portions 44*b* and the connecting members 56. In this configuration, when each piezoelectric element 31 is driven, the electric current flows from the common electrode 32 to the ground terminals 47 through the above-indicated two routes. Consequently, the electric resistance between the ground terminals 47 and the piezoelectric elements 31 located distant from the ground terminals 47 is low, so that it is possible to reduce a variation in the potential of the common electrode 32 among the plurality of piezoelectric elements 31 located at different positions.

As shown in FIGS. 3-5, annular conductors 45 are provided on the intermediate insulating layer 41, namely, on the upper surface of the piezoelectric actuator 22, so as to surround the respective through-holes 29. The thickness of each annular conductor 45, i.e., the height of each annular conductor 45 from the upper surface of the piezoelectric actuator 22 to an upper end face of the annular conductor 45, is 1.0 μm, for instance. To regions of the upper surface of the piezoelectric actuator 22 around the respective through-holes 29, the reservoir defining member 23 is bonded via the annular conductors 45.

The annular conductors 45 are conducted to distal ends of the second conductive portions 44*b* that extend from the first conductive portion 44*a* to the intermediate region between the two pressure-chamber rows 28. As shown in FIG. 3, two annular conductors 45 for corresponding two pressure chambers 26 in the left and right pressure-chamber rows 28*a*, 28*b* are conducted to branched distal ends of one second conductive portion 44*b*. In the present embodiment, it can be construed that the two annular conductors 45 are conducted to respective two second conductive portions 44*b* which are common for the most part thereof. Each annular conductor 45 is conducted, via the corresponding second conductive portion 44*b* and the corresponding connecting member 56, to the common electrode 32 which is disposed below the annular conductor 45 and with which the annular conductor 45 cooperates to sandwich the piezoelectric-member protective layer 40 and the intermediate insulating layer 41 therebetween. The annular conductors 45 have the ground potential, like the common electrode 32.

As shown in FIGS. 4 and 5, each annular conductor 45 is exposed, at its inner end surface, to a flow path defined by the corresponding through-hole 29. Consequently, the ink supplied from the reservoir defining member 23 to the pressure chamber 26 via the through-hole 29 contacts the annular conductor 45 in the flow path defined by the through-hole 29, so that the potential of the ink that has contacted the annular conductor 45 becomes equal to the ground potential. As a result, the ink is prevented from being electrically charged.

In the present embodiment, the wiring protective layer 43 covering the individual wirings 42 and the common wiring 44 is formed on the intermediate insulating layer 41, thereby enhancing insulation among the plurality of individual wirings 42 and between the individual wirings 42 and the common wiring 44. For instance, the wiring protective layer 43 is formed of silicon nitride (SiNx) and has a thickness of 0.1-1 μm. As shown in FIGS. 3 and 4, the wiring protective layer 43 is not formed at the right end portion of the flow-path defining plate 21, and the drive terminals 46 and the ground terminals 47 are not covered by the wiring protective layer 43. The wiring protective layer 43 may be eliminated depending upon various conditions such as the materials and the pitches of the wirings. For instance, the wiring protective layer 43 may be eliminated in an instance where the individual wirings 42 and the common wiring 44 are formed of gold.

COF

As shown in FIGS. 2 and 3, the COF 50 is connected, at one end thereof, to the upper surface of the right end portion of the flow-path defining plate 21 at which the drive terminals 46 and the ground terminals 47 are disposed. A driver IC 51 is mounted on the COF 50. The COF 50 is connected, at the other end thereof, to the controller 6 (FIG. 1) of the printer 1. The COF 50 has a plurality of drive wirings 52 (FIG. 4) and ground wirings (not shown). The drive wirings 52 are connected to respective output terminals of the driver IC 51. In a state in which the COF 50 is bonded to the right end portion of the flow-path defining plate 21, the drive wirings 52 are electrically connected to the respective drive terminals 46. At the same time, the ground wirings of the COF 50 are electrically connected to the respective ground terminals 47.

The driver IC 51 generates a drive signal based on a control signal sent from the controller 6 and outputs the generated drive signal to the piezoelectric elements 31. The drive signal is input to the drive terminals 46 via the drive wirings 52 and is supplied to the individual electrodes 34 via the individual wirings 42. In this instance, the potential of the individual electrodes 34 changes between a predetermined drive potential and the ground potential. On the other hand, the potential of the common electrode 32 that is in contact with the ground terminals 47 via the common wiring 44 is kept at the ground potential.

There will be next explained an operation of each piezoelectric element 31 when the drive signal is supplied thereto from the driver IC 51. In a state in which the drive signal is not input, the potential of the individual electrode 34 is kept at the ground potential, namely, the individual electrode 34 has the same potential as the common electrode 32. When the drive signal is input to the individual electrode 34 in this state, an electric field acts on the active portion 36 of the piezoelectric member 33 in the thickness direction due to the potential difference between the individual electrode 34 and the common electrode 32. In this instance, the active portion 36 over the insulating layer 30 is deformed, so that the entirety of the piezoelectric element 31 is subjected to flexural deformation so as to protrude toward the pressure chamber 26. As a result, the volume of the pressure chamber 26 is decreased, and a pressure wave is generated in the pressure chamber 26, so that ink droplets are ejected from the nozzle 24 communicating with the pressure chamber 26.

Reservoir Defining Member

The material for the reservoir defining member 23 is not limited. The reservoir defining member 23 may be formed of a silicon plate, like the flow-path defining plate 21, or may be formed of other materials such as resin. The reservoir defining member 23 may have a stacked structure constituted by a plurality of layers formed of mutually different materials.

The reservoir 60 in which the ink is stored is formed at an upper portion of the reservoir defining member 23. The ink is supplied to the reservoir 60 from the corresponding ink cartridge 17 (FIG. 1) held by the cartridge holder 7. At a lower portion of the reservoir defining member 23, two recessed portions 63 corresponding to the respective two piezoelectric members 33 are formed. In a state in which the reservoir defining member 23 is bonded to the upper surface of the flow-path defining plate 21, the two piezoelectric members 33 are accommodated in the respective two recessed portions 63. A plurality of supply paths 64 are formed in a partition wall 65 of the reservoir defining member 23 that defines the two recessed portions 63.

The reservoir defining member 23 is bonded to the piezoelectric actuator 22 with a thermosetting adhesive 66. When bonded, the partition wall 65 of the reservoir defining member 23 is bonded to a region of the piezoelectric actuator 22 located between the two piezoelectric members 33, and the supply paths 64 are brought into communication with the respective through-holes 29. The partition wall 65 is bonded to the regions of the piezoelectric actuator 22 around the through-holes 29 via the annular conductors 45, resulting in enhanced sealing at the regions around the through-holes 29.

As described above, the annular conductors 45 are connected to the common electrode 32 via the connecting members 54, 56, so as to be kept at the same ground potential as the common electrode 32. Further, each annular conductor 45 is exposed to the flow path in the corresponding through-hole 29. Consequently, the ink supplied from the reservoir defining member 23 to the pressure chamber 26 via the through-hole 29 comes into contact with the annular conductor 45 in the flow path of the through-hole 29, so that the potential of the ink becomes equal to the ground potential. In the present embodiment, the potential of the ink is made equal to the ground potential and the ink is accordingly prevented from being electrically charged in a simple configuration in which the annular conductors 45 kept at the ground potential are exposed to the flow paths in the through-holes 29. That is, it is not necessary to additionally provide any structure exclusively for making the potential of the ink equal to the ground potential, thus obviating an increase in the size of the head unit 16.

The common electrode 32 is connected, via the connecting members 56, to the common wiring 44 provided on the upper surface of the piezoelectric actuator 22. Moreover, each annular conductor 45 is connected to the corresponding second conductive portion **44*b* of the common wiring 44 that extends to the vicinity of the corresponding through-hole 29, whereby the annular conductor 45 is kept at the ground potential. That is, the annular conductors 45 are held at the ground potential by utilizing the structure for connecting the common electrode 32 to the ground terminals 47. It is thus not necessary to provide any special structure for keeping the potential of the annular conductors 45** at the ground potential.

It is conceivable that the common electrode 32 is partly exposed to the flow path in each through-hole 29 for permitting the ink to contact the common electrode 32. In an instance where the thickness of the common electrode 32 is very small (e.g., 0.1 μm) as in the present embodiment, however, the exposed area of the common electrode 32 is small, so that the ink hardly contacts the common electrode 32 even if the common electrode 32 is exposed to the flow path in each through-hole 29. In contrast, the annular conductors 45 in the present embodiment has a thickness (e.g., 1.0 μm) larger than that of the common electrode 32, resulting in a larger area of contact with the ink. Thus, it is easier to keep the potential of the ink at the ground potential in the present embodiment, as compared with the configuration in which the common electrode 32 is exposed.

As shown in FIG. 2, the second conductive portions **44*b* of the common wiring 44 extend leftward from the annular conductors 45 toward the first conductive portion 44*a* while the individual wirings 42 extend rightward from the individual electrodes 34. That is, the second conductive portions 44*b* of the common wiring 44 and the individual wirings 42 extend in mutually different directions, so that the second conductive portions 44*b* and the individual wirings 42 can be easily laid out on the upper surface of the piezoelectric actuator 22**.

As shown in FIG. 3, the through-hole 29 is disposed so as to overlap an inner end portion of the corresponding pressure chamber 26. That is, in the right pressure-chamber row **28*a*, the through-hole 29 overlaps the left end portion of the corresponding pressure chamber 26. In the left pressure-chamber row 28*b*, the through-hole 29 overlaps the right end portion of the corresponding pressure chamber 26. In this configuration, each of the second conductive portions 44***b* connected to the annular conductors 45 for the right pressure-chamber row 28*a* that is located remote from the first conductive portion 44*a* only needs to pass between corresponding adjacent two pressure chambers 26 in the left pressure-chamber row 28*b*, without passing between adjacent two pressure chambers 26 in the right pressure-chamber row 28*a*. Therefore, each of the individual wirings 42 drawn from the respective individual electrodes 34 for the left pressure-chamber row 28*b* can be easily disposed so as to pass between the corresponding adjacent two pressure chambers 26 in the right pressure-chamber row 28*a*.

In the present embodiment, the head unit 16 is one example of "liquid ejecting device". The flow-path defining plate 21 is one example of "flow-path defining member". The reservoir defining member 23 is one example of "liquid supply member". The conveyance direction is one example of "first direction", and the scanning direction is one example of "second direction".

Some modifications of the illustrated first embodiment will be explained. In the following modifications, the same reference numerals as used in the first embodiment are used to identify the corresponding components, and a detailed explanation thereof is dispensed with.

Figure 6:
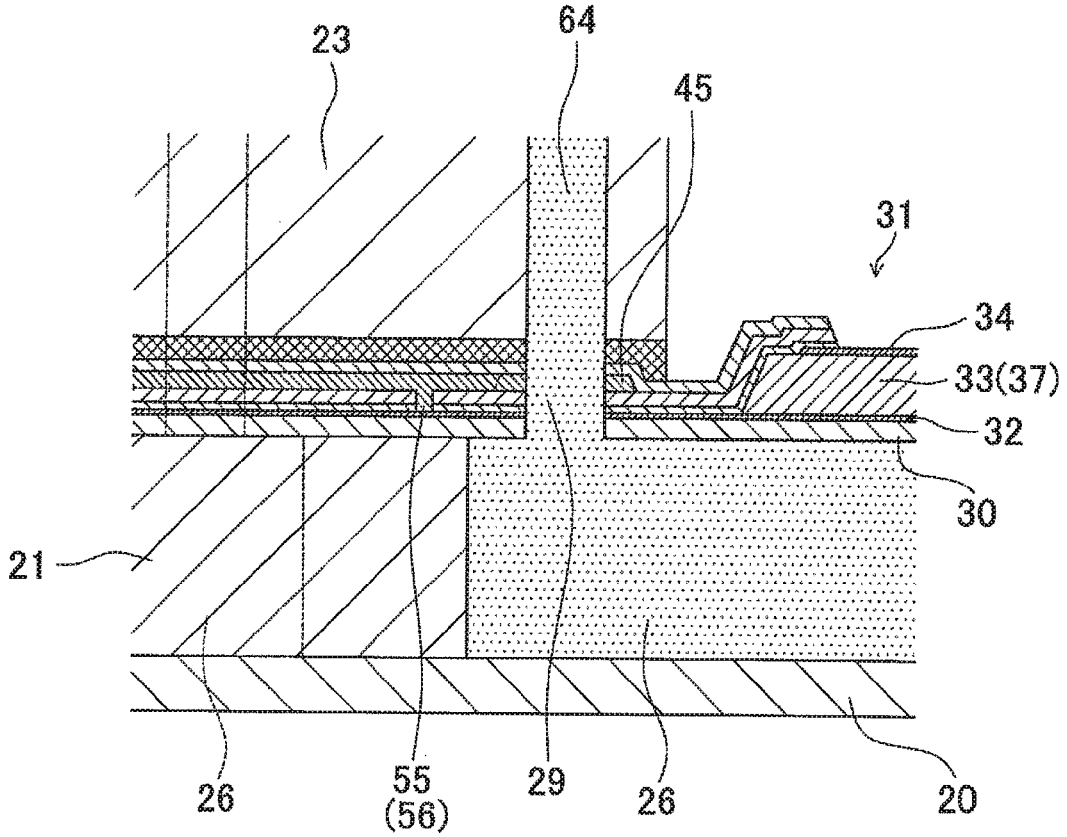
FIG. 6 is a cross-sectional view of a modification of the first embodiment, the view corresponding to FIG. 5.

(1) As shown in FIG. 6, not only the annular conductors 45 but also the common electrode 32 may be exposed to the flow-path in each through-hole 29. In this configuration, conducted portions kept at the ground potential have a larger area of contact with the ink.

Figure 7:
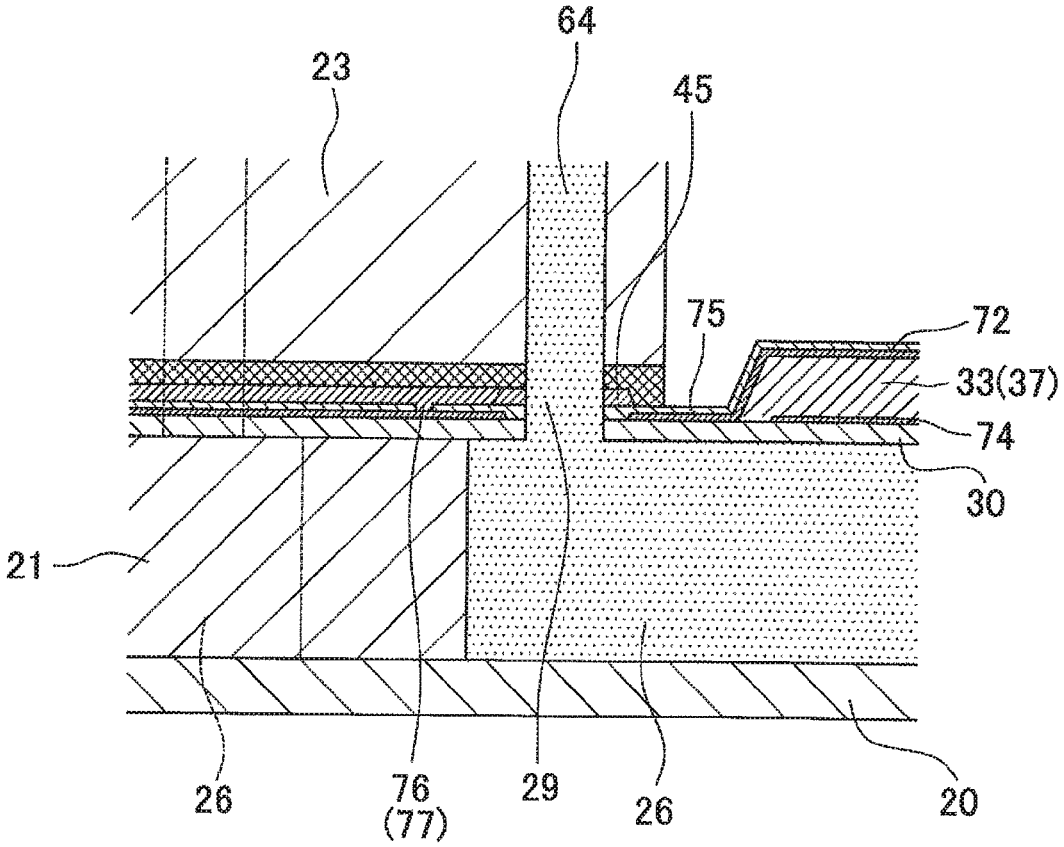
FIG. 7 is a cross-sectional view of another modification, the view corresponding to FIG. 5.

(2) In the first embodiment, the common electrode 32 is provided below the piezoelectric members 33, and the individual electrodes 34 are provided above the piezoelectric members 33. As shown in FIG. 7, individual electrodes 74 may be provided below the piezoelectric members 33, and a common electrode 72 may be provided above the piezoelectric members 33. In this configuration, the common electrode 72 provided above the piezoelectric members 33 is covered with an insulating layer 75, and the annular conductors 45 are provided on the insulating layer 75. Each annular conductor 45, which cooperates with the common electrode 72 to sandwich the insulating layer 75 therebetween, is connected to the common electrode 72 via a connecting member 77 provided in a corresponding one of contact holes 76 formed in the insulating layer 75.

Figure 8A:
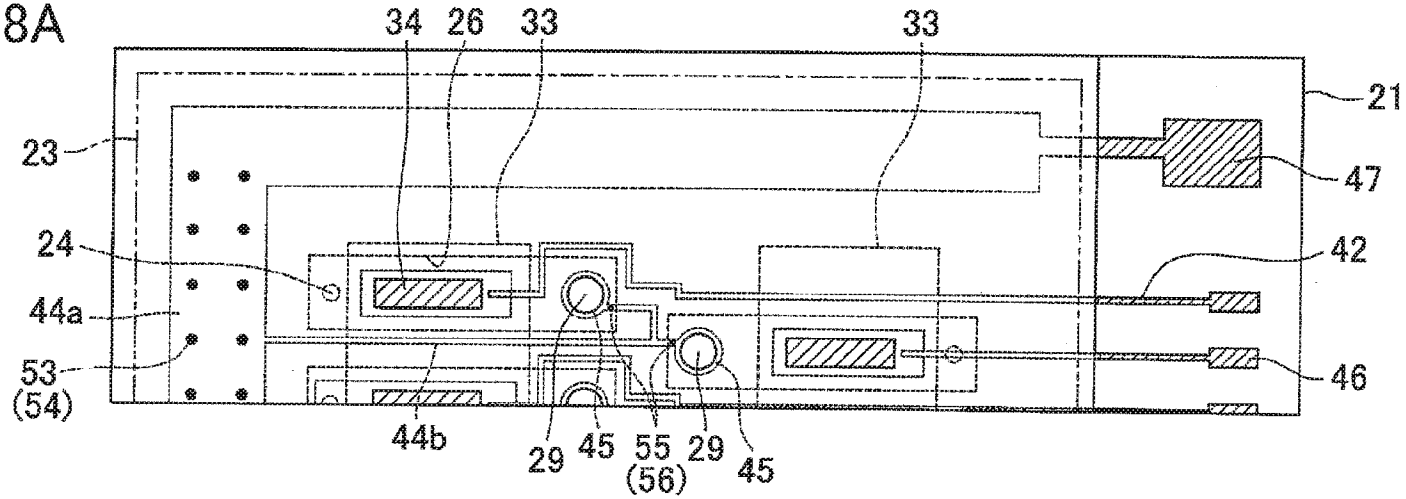
FIGS. 8A and 8B are partially enlarged plan views of head units of further modifications.
Figure 8B:
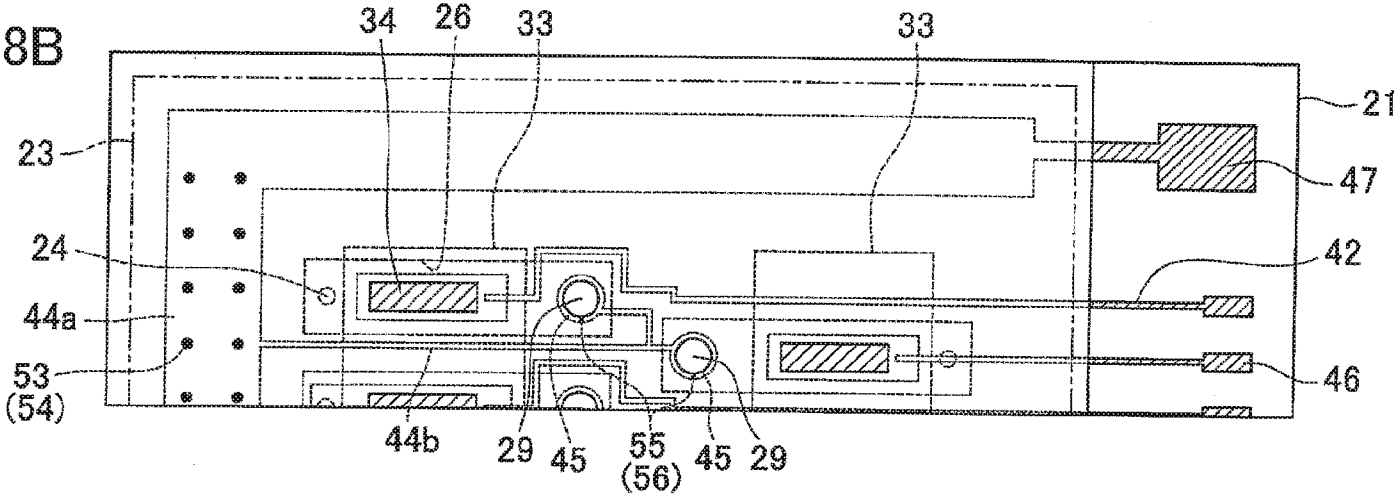

(3) Positions of the contact holes 55 and the connecting members 56 connecting the annular conductors 45 and the common electrode 32 may be suitably changed. As shown in FIG. 8A, the connecting member 56 may be disposed in a region in which the connecting member 56 overlaps the corresponding pressure chamber 26 as viewed from a direction of stacking of the plurality of layers of the piezoelectric actuator 22. Alternatively, as shown in FIG. 8B, the connecting member 56 may be disposed so as to overlap the corresponding annular conductor 45, and the annular conductor 45 may be connected directly to the common electrode 32 by the connecting member 56.

(4) In the first embodiment, the piezoelectric-member protective layer 40 and the intermediate insulating layer 41 are disposed between the annular conductors 45 and the common electrode 32. The layers interposed between the annular conductors 45 and the common electrode 32 may be suitably changed. For instance, a part of the piezoelectric layer 37 that constitutes the piezoelectric member 33 may be interposed between the annular conductors 45 and the common electrode 32. In the first embodiment, any one of the piezoelectric-member protective layer 40 and the intermediate insulating layer 41 may be eliminated.

(5) The annular conductors 45 need not necessarily be connected to the common wiring 44 that connects the common electrode 32 and the ground terminals 47. That is, each annular conductor 45 may be connected directly to the ground terminals 47 by another wiring different from the common wiring 44, without being connected to the common electrode 32 located below the annular conductor 45 through the corresponding contact hole 55.

Figure 9:
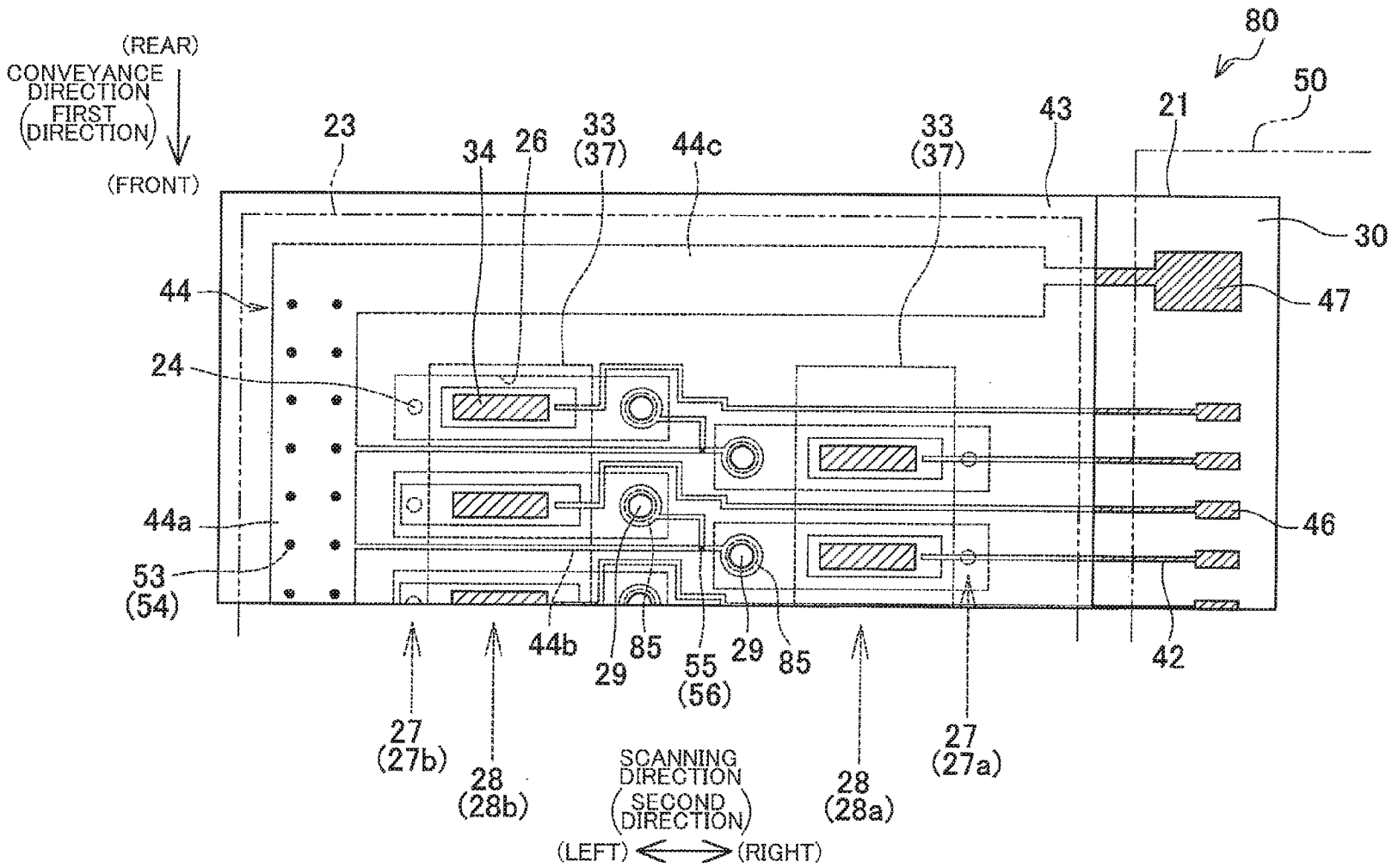
FIG. 9 is a partially enlarged plan view of a head unit according to a second embodiment.
Figure 10:
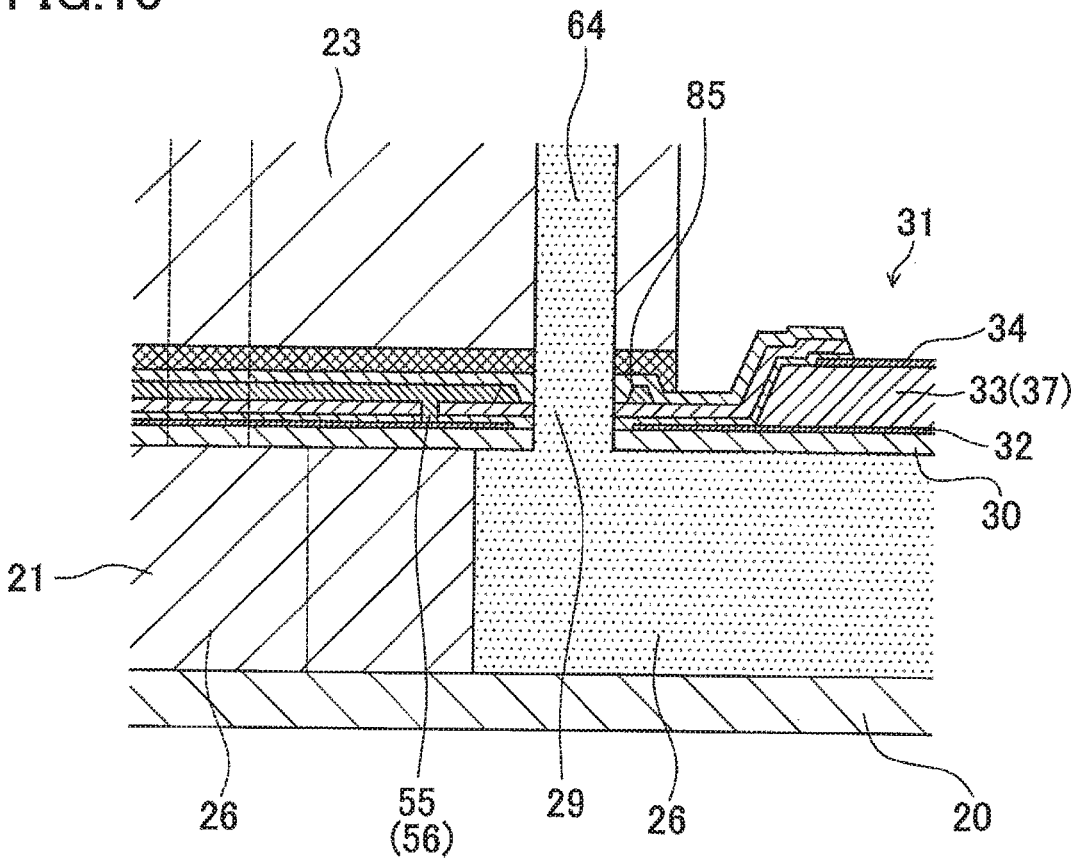
FIG. 10 is a cross-sectional view of the head unit of FIG. 9.

There will be next explained a second embodiment. FIG. 9 is a partially enlarged plan view of a head unit 80 according to the second embodiment. FIG. 10 is a cross-sectional view of the head unit 80 of FIG. 9.

The head unit 80 of the second embodiment shown in FIGS. 9 and 10 differs from the head unit 16 of the first embodiment (FIGS. 3 and 5) in that each of annular conductors 85 is not exposed to the flow path in the corresponding through-hole 29. Components other than the annular conductors 85 are the same as those in the first embodiment, and a detailed explanation thereof is dispensed with.

In the second embodiment, because each annular conductor 85 is not exposed to the flow path in the through-hole 29, the annular conductor 85 does not contact the ink. In the second embodiment, therefore, the annular conductors 85 when conducted to the common wiring 44 do not offer the advantage of preventing the ink from being electrically charged, unlike in the first embodiment. In this respect, it may be unnecessary to connect the annular conductors 85 to the common wiring 44.

In the second embodiment, however, the contact holes 55 and the connecting members 56 for connecting the common wiring 44 and the common electrode 32 are located in the intermediate region between the two pressure-chamber rows 28. That is, the connecting member 56 is located close to the annular conductor 85 that is located at a position overlapping the inner end portion of the pressure chamber 26. In this instance, if the second conductive portion 44*b* of the common wiring 44 connected to the connecting member 56 is disposed so as to bypass the annular conductor 85, it may take up additional space depending upon the layout. To avoid such inconvenience, the annular conductor 85 is connected to the second conductive portion 44*b* for space saving.

Figure 11A:
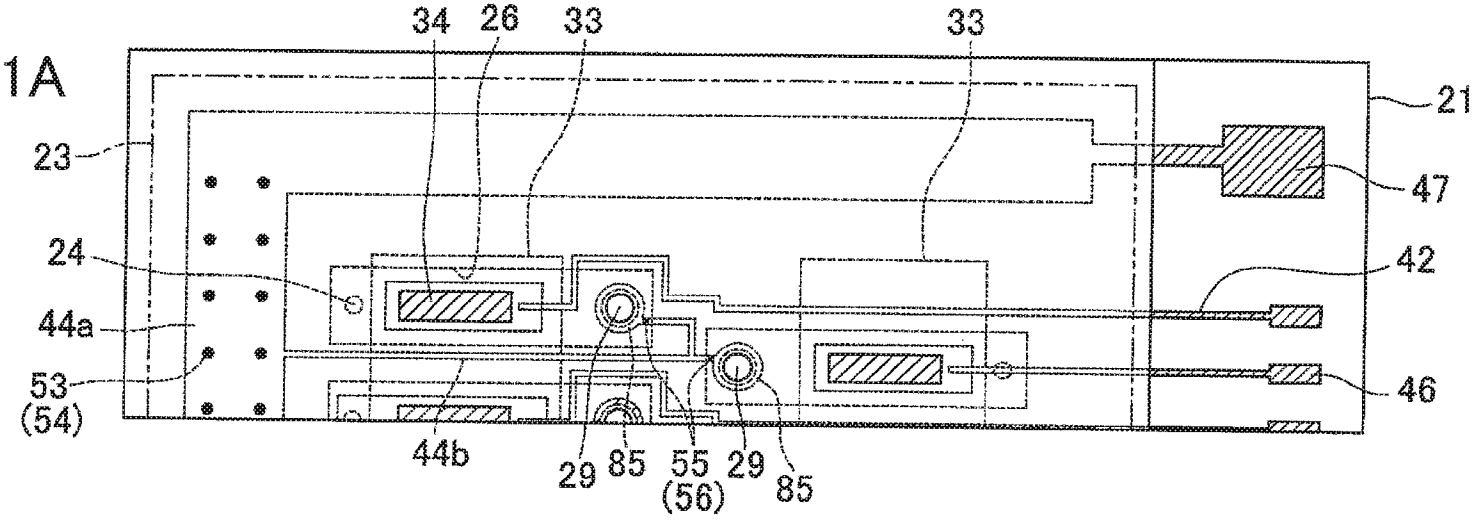
FIGS. 11A and 11B are partially enlarged cross-sectional views of head units according to modifications of the second embodiment.
Figure 11B:
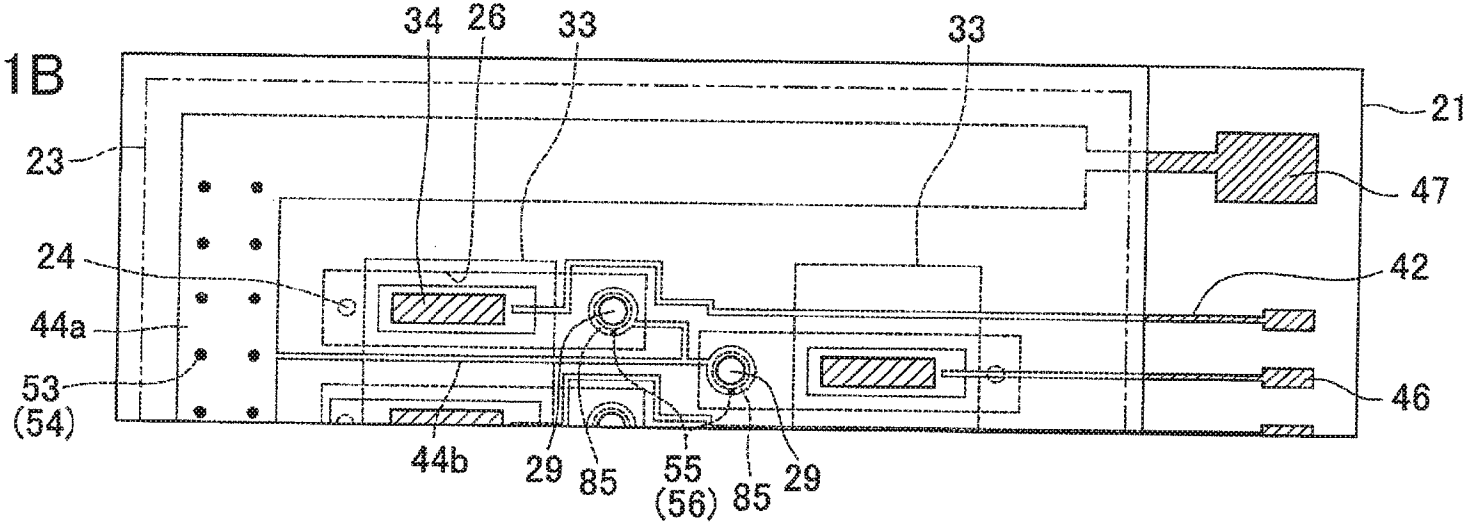

FIGS. 11A and 11B are partly enlarged plan views of head units according to modifications. Also in a configuration shown in FIG. 11A in which the contact hole 55 and the connecting member 56 are disposed in a region overlapping the pressure chamber 26, the connecting member 56 and the annular conductor 85 are located close to each other. It is thus preferable to connect the annular conductor 85 to the second conductive portion 44*b*. Alternatively, as shown in FIG. 11B, the annular conductor 85 may be connected to the second conductive portion 44*b*, the contact hole 55 and the connecting member 56 may be disposed so as to overlap the annular conductor 85, and the annular conductor 85 may be connected directly to the common electrode 32 by the connecting member 56.

In the illustrated embodiments, the disclosure is applied to the ink-jet head configured to print images and the like on the recording sheet by ejecting the ink thereto. It is to be understood that the disclosure is applicable to other liquid ejecting devices in a variety of uses other than printing of images. For instance, the disclosure is applicable to a liquid ejecting device configured to eject an electrically conductive liquid to a substrate so as to form a conductive pattern on the surface of the substrate.

What is claimed is:

1. A liquid ejecting device, comprising:

a flow-path defining member in which a plurality of pressure chambers are formed;

a piezoelectric actuator constituted by a plurality of layers stacked on one another and including a piezoelectric layer, a common electrode disposed on one surface side of the piezoelectric layer, and individual electrodes disposed on another surface side of the piezoelectric layer, the piezoelectric actuator being superposed on the flow-path defining member and having through-holes communicating with the respective pressure chambers;

a plurality of annular conductors, each of which surrounds a periphery of a corresponding one of the through-holes, at least one of the plurality of layers being sandwiched between the annular conductors and the common electrode;

a liquid supply member in which a reservoir and supply paths are formed, the supply paths in communication with the reservoir and configured to supply the liquid to the respective pressure chambers through the respective through-holes; and an adhesive interposed between the liquid supply member and the plurality of annular conductors, wherein each of the annular conductors is connected to a terminal configured to be provided with a predetermined constant potential, and is exposed to a flow path defined by a corresponding one of the through-holes.

2. The liquid ejecting device according to claim 1, wherein each of the annular conductors has a larger thickness than the common electrode.

3. The liquid ejecting device according to claim 1, wherein the common electrode is kept at the predetermined constant potential, and wherein each of the annular conductors and the common electrode are electrically connected via a corresponding one of a plurality of contact holes formed through the at least one of the plurality of layers of the piezoelectric actuator.

4. The liquid ejecting device according to claim 3, wherein the plurality of pressure chambers are arranged along a first direction, wherein the liquid ejecting device further comprises a common wiring including:

a first conductive portion located on one of opposite sides of the pressure chambers in a second direction, orthogonal to the first direction, nearer to one end portion of the liquid ejecting device in the second direction; and a plurality of second conductive portions extending from the first conductive portion in a third direction opposite to the second direction such that each of the plurality of second conductive portions is conducted to a corresponding one of the plurality of annular conductors, and wherein one of: each of the second conductive portions; and each of the annular conductors is connected to the common electrode via a corresponding one of the plurality of contact holes.

5. The liquid ejecting device according to claim 4, further comprising individual wirings each of which extends from a corresponding one of the individual electrodes of the plurality of pressure chambers in the third direction.

6. The liquid ejecting device according to claim 4, wherein the plurality of pressure chambers form a first pressure-chamber row extending in the first direction and a second pressure-chamber row extending in the first direction and disposed on one of opposite sides of the first pressure-chamber row in the second direction nearer to the one end portion of the liquid ejecting device, and wherein the second conductive portion connected to the annular conductor provided for each of the pressure chambers in the first pressure-chamber row is connected to the first conductive portion so as to pass between corresponding adjacent two of the pressure chambers in the second pressure-chamber row.

7. The liquid ejecting device according to claim 6, wherein the through-hole and the annular conductor provided for each of the pressure chambers in the first pressure-chamber row are disposed so as to overlap one of opposite end portions of a corresponding one of the pressure chambers nearer to the one end portion of the liquid ejecting device in the second direction, as viewed from a direction in which the plurality of layers of the piezoelectric actuator are stacked.

8. A liquid ejecting device, comprising:

a flow-path defining member in which a plurality of pressure chambers are formed;

a piezoelectric actuator constituted by a plurality of layers stacked on one another and including a piezoelectric layer, a common electrode disposed on one surface side of the piezoelectric layer, and individual electrodes disposed on another surface side of the piezoelectric layer, the piezoelectric actuator being superposed on the flow-path defining member and having through-holes communicating with the respective pressure chambers;

a plurality of annular conductors, each of which surrounds a periphery of a corresponding one of the through-holes, at least one of the plurality of layers being sandwiched between the annular conductors and the common electrode;

a plurality of contact holes formed through the at least one of the plurality of layers of the piezoelectric actuator so as to electrically connect the annular conductors and the common electrode;

a liquid supply member in which a reservoir and supply paths are formed, wherein the supply paths are in communication with the reservoir, and are configured to supply the liquid to the respective pressure chambers through the respective through-holes; and an adhesive interposed between the liquid supply member and the plurality of annular conductors.

9. The liquid ejecting device according to claim 8, wherein the plurality of pressure chambers are arranged along a first direction, wherein the liquid ejecting device further comprises a common wiring including:

a first conductive portion located on one of opposite sides of the pressure chambers in a second direction, orthogonal to the first direction, nearer to one end portion of the liquid ejecting device in the second direction; and a plurality of second conductive portions extending from the first conductive portion in a third direction opposite to the second direction such that each of the plurality of second conductive portions is conducted to a corresponding one of the plurality of annular conductors, and wherein each of the second conductive portions is connected to the common electrode via a corresponding one of the plurality of contact holes.

10. The liquid ejecting device according to claim 9, wherein the plurality of pressure chambers form two pressure-chamber rows arranged alongside in the second direction, wherein each of the through-holes is disposed so as to overlap an inner end portion of a corresponding one of the pressure chambers in the second direction as viewed from a direction in which the plurality of layers of the piezoelectric actuator are stacked, and wherein the contact holes are disposed in a region between the two pressure-chamber rows.

11. The liquid ejecting device according to claim 9, wherein each of the contact holes is disposed in a region in which the contact hole overlaps a corresponding one of the pressure chambers as viewed from a direction of stacking of the plurality of layers of the piezoelectric actuator.

12. The liquid ejecting device according to claim 8, wherein the plurality of pressure chambers are arranged along a first direction, wherein the liquid ejecting device further comprises a common wiring including:

a first conductive portion located on one of opposite sides of the pressure chambers in a second direction, orthogonal to the first direction, nearer to one end portion of the liquid ejecting device in the second direction; and a plurality of second conductive portions extending from the first conductive portion in a third direction opposite to the second direction such that each of the plurality of second conductive portions is conducted to a corresponding one of the plurality of annular conductors, and wherein each of the second conductive portions is connected directly to the common electrode via a corresponding one of the plurality of contact holes.

* * * * *